US005634328A

United States Patent [19]

Ansart et al.

[11] Patent Number: 5,634,328

[45] Date of Patent: Jun. 3, 1997

[54] METHOD OF SUPPLYING FUEL TO A DUAL HEAD COMBUSTION CHAMBER

[75] Inventors: Denis R. H. Ansart, Bois le Roi; Bruno M. Quinqueneau, Massy; Denis J. M. Sandelis, Nangis, all of France

[73] Assignee: Societe Nationale d'Etude et de Construction de Moteurs d'Aviation S.N.E.C.M.A., Paris Cedex, France

[21] Appl. No.: 561,335

[22] Filed: Nov. 21, 1995

[30] Foreign Application Priority Data

Nov. 23, 1994 [FR] France ..... 94 14013

[51] Int. Cl.[6] ..... F23R 3/34

[52] U.S. Cl. ..... 60/37.03; 60/747

[58] Field of Search ..... 60/39.03, 39.06, 60/739, 747

[56] References Cited

U.S. PATENT DOCUMENTS

| | | |
|---|---|---|
| 4,292,801 | 10/1981 | Wilkes et al. . |
| 4,499,735 | 2/1985 | Moore et al. . |
| 4,735,052 | 4/1988 | Maeda et al. . |
| 5,257,502 | 11/1993 | Napoli ..... 60/747 |
| 5,289,685 | 3/1994 | Hoffa . |
| 5,319,919 | 6/1994 | Nakayama et al. . |

FOREIGN PATENT DOCUMENTS

| | | |
|---|---|---|
| 399336 | 11/1990 | European Pat. Off. . |
| 2421342 | 10/1978 | France . |
| 2174147 | 10/1986 | United Kingdom . |
| 2214630 | 9/1989 | United Kingdom . |

*Primary Examiner*—Louis J. Casaregola
*Attorney, Agent, or Firm*—Bacon & Thomas

[57] ABSTRACT

A method of supplying fuel to a combustion chamber of a turbojet engine having a low power head with a plurality of low power fuel injectors and a high power head having a plurality of high power fuel injectors is disclosed in which fuel is supplied to the plurality of low power fuel injectors during low power operation of the engine, fuel is supplied to a first fuel circuit in the plurality of high power fuel injectors during high power operation of the turbojet engine and fuel is also supplied to a second fuel circuit in the plurality of high power fuel injectors during low power operation of the turbojet engine, the second fuel circuit being separate from the first fuel circuit. This method of supplying fuel to the dual head combustion chamber optimizes operation of the combustion chamber in all modes of engine operation.

5 Claims, 4 Drawing Sheets

METHOD OF SUPPLYING FUEL TO A DUAL HEAD COMBUSTION CHAMBER

BACKGROUND OF THE INVENTION

The present invention relates to a method of supplying fuel to a combustion chamber of a turbojet engine having both a low power head with a plurality of low power fuel injectors and a high power head having a plurality of high power fuel injectors.

Aircraft turbojet engines are required to operate in various modes both at very high power output and at relatively low power output. Turbojet engines utilized in military aircraft must also minimize infra-red emissions in order to prevent detection of the presence of the aircraft during any mode of operation. Accordingly, fume emissions from carbon particles and infra-red emitting fumes from nitrogen oxides must be reduced. The carbon particles and fumes are produced predominantly during high power operations.

Dual head combustion chambers are known to reduce polluting emissions of the turbojet engine especially during high power operations. The high power, or take off, head is optimized for full power operation and feeds a sufficiently lean fuel/air mixture to the combustion chamber to reduce fume production and the formation of large quantities of nitrogen oxides. In low power operation, only the low power head supplies a rich fuel/air mixture to the primary zone of the combustion chamber to ensure flame stability, thereby preventing engine flame-out. The richness of the fuel/air mixture produces large quantities of fume emissions during such low power operations.

Typically, the high power or take-off head and the low power head are radially displaced from each other about the axis of the turbojet engine. This causes a non-homogeneous radial temperature distribution in the gases emanating from the combustion chamber and contacting the turbine blades of the engine. Such non-homogeneous radial temperature distribution diminishes the useful life of the turbine blades.

The high power or take-off head is typically supplied with fuel only beyond 25% of the nominal engine thrust which causes the richness of the fuel/air mixture in the primary zone of the combustion chamber to drop markedly when operation of the high power head is initiated due to the relatively leaner fuel/air mixture than that supplied by the low power head.

It is known to supply a single head, conventional combustion chamber with dual injectors comprising two coaxial tubes feeding fuel to separate zones of the combustion chamber through separate fuel circuits and separate air circuits. Such a system is illustrated in British Patent No. A 2,214,630 which describes a dual injector having two separate fuel circuits, a main feed circuit associated with a first axial swirler to feed a central zone and second feed circuit associated with a second axial swirler to feed an annular zone through channels in the blades of the first swirler. The central zone is operative at low power while the annular zone operates only at high power.

French Patent No. A 2,421,342 also describes a double zone injector wherein the central zone operates only at high power. These documents are silent on the concept of such double zone injectors outfitting a takeoff head of a dual head combustion chamber.

SUMMARY OF THE INVENTION

A method of supplying fuel to a combustion chamber of a turbojet engine having a low power head with a plurality of low power fuel injectors and a high power head having a plurality of high power fuel injectors is disclosed in which fuel is supplied to the plurality of low power fuel injectors during low power operation of the engine, fuel is supplied to a first fuel circuit in the plurality of high power fuel injectors during high power operation of the turbojet engine and fuel is also supplied to a second fuel circuit in the plurality of high power fuel injectors during low power operation of the turbojet engine, the second fuel circuit being separate from the first fuel circuit. This method of supplying fuel to the dual head combustion chamber optimizes operation of the combustion chamber in all modes of engine operation.

The low power head and the high power head are radially displaced from each other about the longitudinal axis of the turbojet engine. The method enriches the fuel/air mixture in the primary zone of the combustion chamber during the lower power mode of operation to be at least 80% of the stoichiometric ratio. The fuel flow supplied to the second fuel circuit is controlled to remain between 40–50% of the total fuel flow (Wf) supplied by the second fuel circuit and the low power head. Fuel flow through the first circuit of the high power fuel injector begins when the engine reaches approximately 20% of its nominal ground thrust.

DETAILED DESCRIPTION OF THE PREFERRED EMBODIMENT

Figure 1:
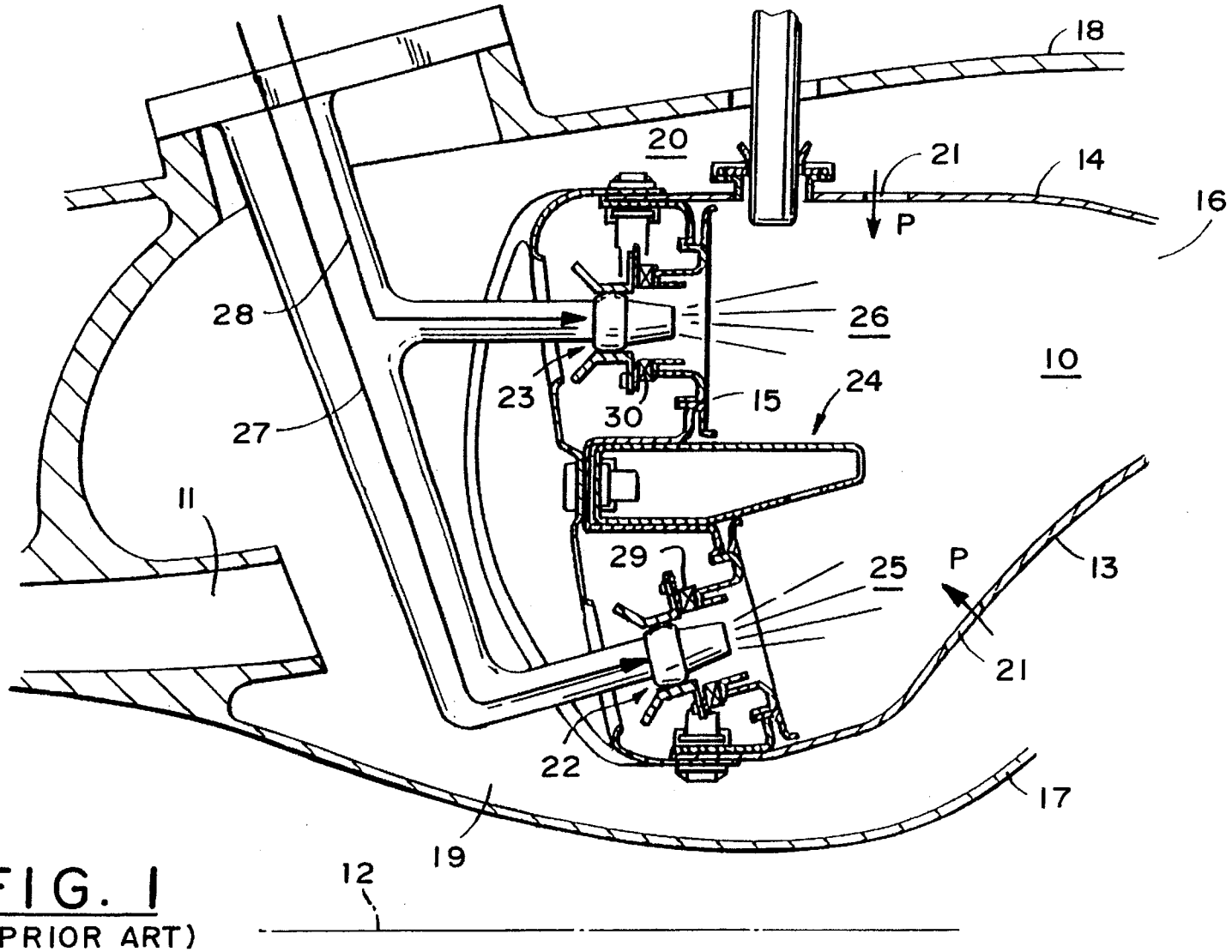
FIG. 1 (PRIOR ART)
FIG. 1 is a partial, cross-sectional view of a conventional dual head combustion chamber for a turbojet engine.

In FIG. 1, 10 denotes a conventional, dual head combustion chamber supplied with compressed air through a diffuser 11 located downstream of the engine air compressor (not shown). The combustion chamber 10 is generally annular in configuration about longitudinal axis 12 and is bounded by inner wall 13, outer wall 14 and end wall 15 which connects the upstream ends (towards the left as viewed in FIG. 1) of the inner and outer walls 13 and 14. The combustion chamber exhaust passage 16 directs the exhaust gases toward the blades of the engine turbine (not shown).

The combustion chamber 10 is located between an inner casing 17 and an outer casing 18 which are interconnected with the diffuser 11 and, together with the combustion chamber walls 13 and 14, define annular passages 19 and 20 to direct the flow of primary air P feeding the combustion chamber 10 through orifices 21 and to direct the flow of air cooling the air chamber walls 13 and 14.

A plurality of high power, or take-off injectors 22 and a plurality of low power injectors 23 are located in the end wall 15 and are arranged in radially spaced apart annular arrays around the longitudinal axis 12. A partition plate 24 is mounted to the end wall 15 between the high power fuel injectors 22 and the low power fuel injectors 23, respectively, and extends inwardly into the combustion chamber generally towards the exhaust passage 16. Plate 24 divides the upstream end of the combustion chamber 10 into a first primary zone fed by the high power injectors 22 called the high power head 25, and a second primary combustion zone fed by the low power injectors 23 and designated the low power head 26. The fuel injectors 22 and 23 are supplied fuel via separate fuel circuits 27 and 28 and each is associated with sets of radial swirler blades 29 and 30 which are supplied with air through the diffuser 11, the air passing through the swirlers serving to vaporize the fuel supplied through the fuel injectors. In such known dual head combustion chambers, the low power fuel injectors operate during low power operating modes, whereas the take-off fuel injectors 22 are supplied fuel only when the engine operation exceeds 25% of the nominal ground thrust, FOO.

Figure 2:
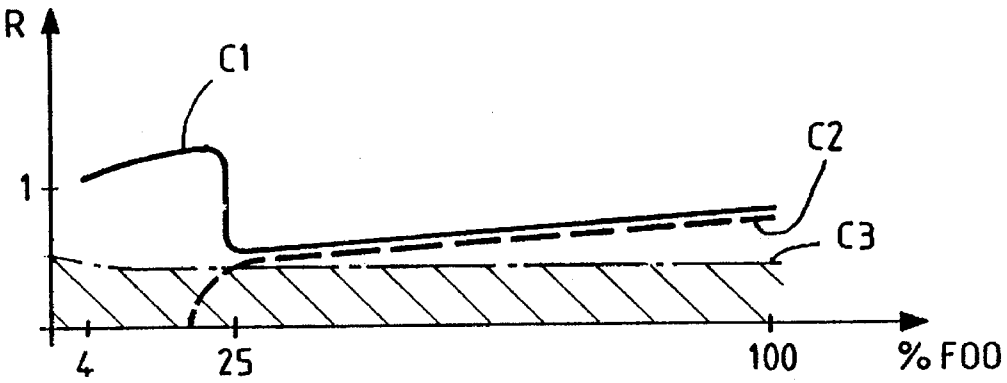
FIG. 2 (PRIOR ART)
FIG. 2 is a graph illustrating the fuel/air mixture richness (R) as a function of the nominal engine thrust (FOO) in a conventional dual head combustion chamber.

The curve C1 illustrated in FIG. 2 represents the fuel/air mixture richness R in the primary zone in the vicinity of the low power head 26 as a function of the nominal thrust FOO. The curve C2 illustrates the fuel/air mixture richness R in the primary zone in the vicinity of the high power head 25, while curve C3 illustrates the minimum fuel/air mixture richness corresponding to the lower operational limit of the engine. It is clear that the curve C1 drops sharply at approximately 25% of the nominal thrust FOO, at which point the high power head is being supplied with fuel. Below 25% of the nominal thrust, the fuel/air mixture richness in this primary zone exceeds the stoichiometric ratio of fuel to air (designated as 1 on the R scale) in order to ensure good flame stability. However, such a level of fuel/air mixture richness generates fumes which are detectable by infrared detectors. Beyond 25% of the nominal thrust FOO, the fuel/air mixture richness in the primary zone is higher than 0.7, but is less than 1 on the R scale.

Figure 4:
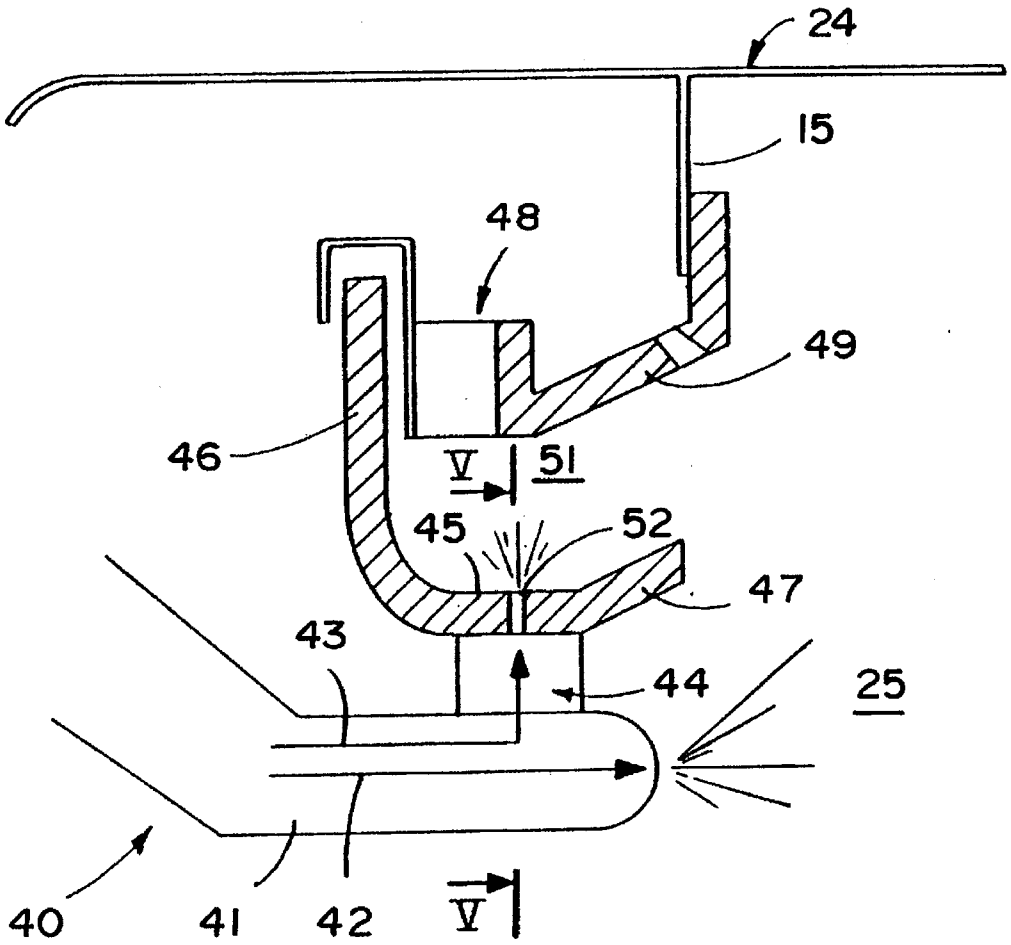
FIG. 4 is a partial, enlarged view of a high power fuel injector utilized in the method according to the present invention.
Figure 6:
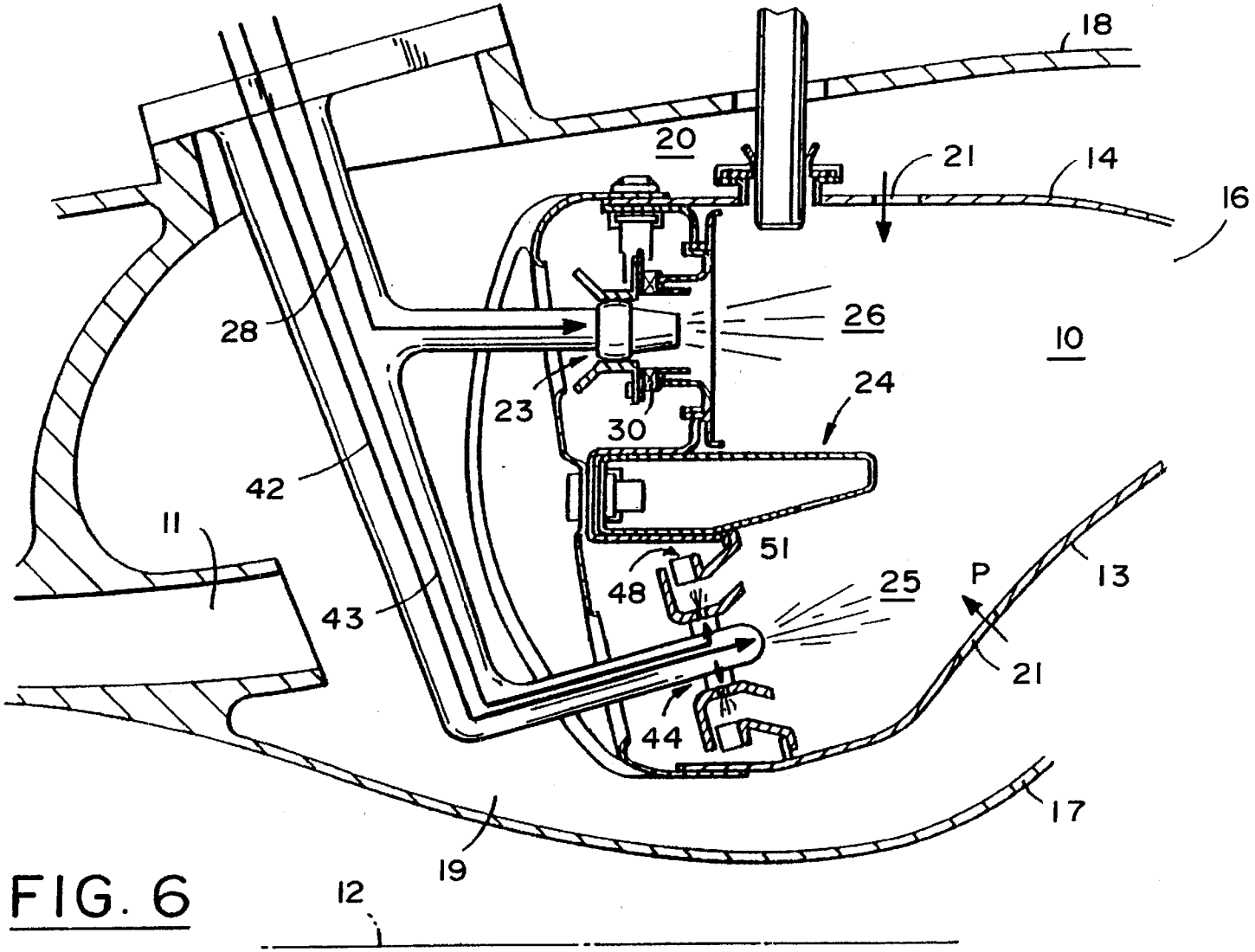
FIG. 6 is a partial cross-sectional view of a dual head combustion chamber supplied with fuel according to the method of the present invention.

In the present invention, the high power head 25 of the above-described dual head combustion chamber has a plurality of high power injectors 40 with two separate fuel circuits. As best seen in FIG. 4, each high power injector 40 comprises a fuel injector portion 41 within which are present both a first fuel circuit 42 which supplies fuel to the high power fuel injector during high power modes of operation and a separate, second fuel circuit 43 which supplies fuel to the high power fuel injectors during the low power mode of operation.

An axial swirler 44 is mounted around the downstream end portion of the high power fuel injector 41. The axial swirler 44 is located inside a collar 45 which extends in a generally downstream direction (towards the right as illustrated in FIG. 4) from radial flange 46 and has a downstream frustoconical wall 47 flaring outwardly. A radial swirler 48 is located downstream of the radial flange 46 as part of a bowl 49 affixed to the combustion chamber end wall 15.

The second fuel circuit 43 passes through each of the vanes 50 of the axial swirler 44 and communicates with orifices 52 formed in the collar 45 such that fuel issues into the annular space 51 bounded by the collar 45 and the bowl 49.

The collar 45 and the frusto-conical wall 47 divide the take-off head 25 into two zones. The first zone is supplied fuel from the first circuit 42 along with air passing through the axial swirler 44. The second zone is supplied fuel from the second fuel circuit 43 and air through the radial swirler 48. In known fashion, the swirlers 44 and 48 may include controls so as to regulate the amount of air passing through each one. The zone receiving the larger air flow may be either the first or the second zone.

The low power fuel injectors 23 and the second fuel circuit 43 are jointly supplied with fuel beginning with the low power operating mode such that the richness of the fuel/air mixture in the primary zone will be at least 80% of the stoichiometric ratio, which will both ensure flame stability and avoid producing detectable fumes. The fuel distribution during the low power operating mode between the second fuel circuit and the low power fuel injectors 23 is such that the second fuel circuit 43 receives between 40% and 50% of the total fuel flow $W_f$ supplied by the second fuel circuit and the lower power head. Beginning at approximately 20% of the nominal thrust and continuing through full power operation, both fuel circuits 42 and 43 of the high power fuel injectors 40 will be simultaneously supplied with fuel.

Figure 3:
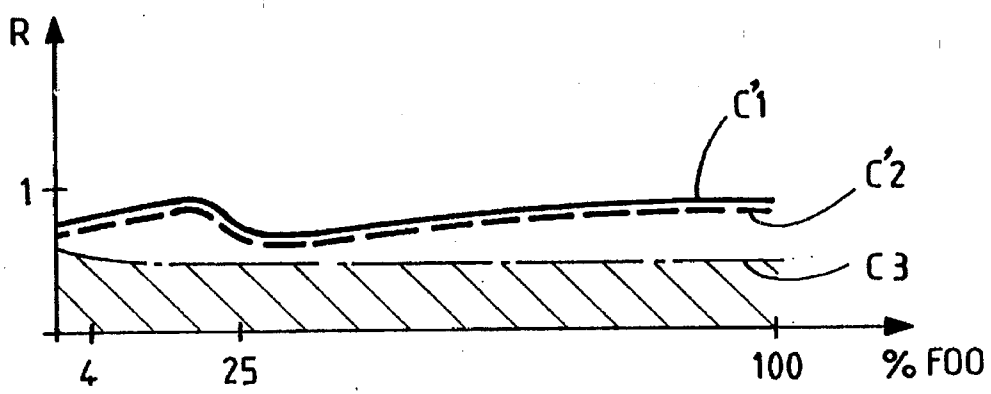
FIG. 3 is a graph similar to FIG. 2, but illustrating the fuel/air mixture richness (R) vs. nominal thrust (FOO) in a combustion chamber supplied with fuel according to the present invention.
Figure 5:
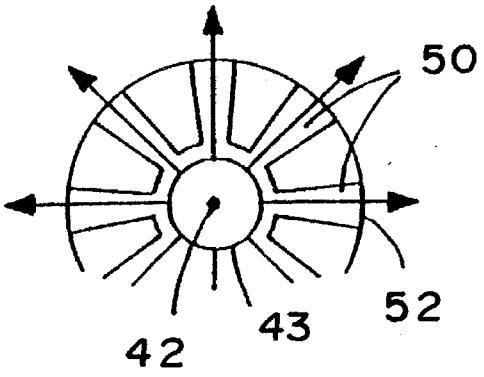
FIG. 5 is a partial, cross-sectional view taken along line V—V in FIG. 4.

FIG. 3 shows representative curves C'1 and C'2 of the fuel/air mixture richness (R) of the primary zones of a dual head combustion chamber supplied with fuel in the above-described method. It will be noted that the fuel/air mixture richness of the low power head and of the high power head are both less than the low power stoichiometric ratio. Such a fuel/air mixture richness is approximately 1 when operating near 20% of the nominal thrust FOO and then drops to 0.7–0.8 near 30% of the nominal thrust, thereupon increasing through full power operation.

Because the two fuel injector heads are supplied during lower power operating modes, the invention increases the homogeneity of the fuel/air mixture as well as increasing the radial homogeneity of the exhaust gas temperatures to thereby increase turbine service life.

The foregoing description is provided for illustrative purposes only and should not be construed as in any way limiting this invention, the scope of which is defined solely by the appended claims.

We claim:

1. A method of supplying fuel to a combustion chamber of a turbojet engine having a low power head having a plurality of low power fuel injectors, a high power head having a plurality of high power fuel injectors and a primary combustion zone, comprising the steps of:

a) supplying fuel to the plurality of low power fuel injectors during low power operation of the turbojet engine;

b) providing first and second separate fuel circuits in each of the high power fuel injectors;

c) supplying fuel to the first fuel circuit in the plurality of high power fuel injectors during high power operation of the turbojet engine; and d) supplying fuel to the second fuel circuit in the plurality of high power fuel injectors during low power operation and high power operation of the turbojet engine.

2. The method of claim 1 wherein fuel is supplied to the low power fuel injectors and the second fuel circuit of the high power fuel injectors during low power operation such that the fuel/air mixture in the primary combustion zone is at least 80% of the stoichiometric ratio.

3. The method of claim 1 wherein the fuel flow supplied to the second fuel circuit of the high power fuel injectors is between 40% and 50% of the total fuel flow supplied to the low power fuel injectors and the second fuel circuit of the high power fuel injectors.

4. The method of claim 1 wherein fuel supply to the first circuit of the high power injectors commences at approximately 20% of the nominal ground thrust of the turbojet engine.

5. The method of claim 1, comprising the additional steps of providing first and second fuel outlets in the first and second circuits, respectively oriented such that fuel emanates from the second fuel outlet generally perpendicularly with respect to the fuel emanating from the associated first fuel outlet.

* * * * *